US007097421B2

(12) United States Patent
Swanson et al.

(10) Patent No.: US 7,097,421 B2
(45) Date of Patent: Aug. 29, 2006

(54) VERNIER DUCT BLOCKER

(75) Inventors: Timothy A. Swanson, Coventry, CT (US); James E. Jones, Palm City, FL (US)

(73) Assignee: United Technologies Corporation, Hartford, CT (US)

( * ) Notice: Subject to any disclaimer, the term of this patent is extended or adjusted under 35 U.S.C. 154(b) by 43 days.

(21) Appl. No.: 10/961,178

(22) Filed: Oct. 8, 2004

(65) Prior Publication Data

US 2006/0078419 A1 Apr. 13, 2006

(51) Int. Cl.
*F01D 25/24* (2006.01)

(52) U.S. Cl. ..... 415/127; 415/159; 60/39.23

(58) Field of Classification Search ..... 415/159, 415/195, 165, 167, 166, 127, 148, 151
See application file for complete search history.

(56) References Cited

U.S. PATENT DOCUMENTS 4,292,802 A 10/1981 Snow
4,534,166 A * 8/1985 Kelm et al. ..... 60/39.23
5,372,485 A * 12/1994 Sumser et al. ..... 417/407
5,799,927 A * 9/1998 Geist ..... 251/212
6,402,465 B1 * 6/2002 Maier ..... 415/159

FOREIGN PATENT DOCUMENTS

DE 14 26 879 A1 3/1969
DE 44 25 344 A1 1/1996

OTHER PUBLICATIONS

European Search Report for EP Patent Application No. 05256247.7.

* cited by examiner

*Primary Examiner*—Edward K. Look
*Assistant Examiner*—Dwayne J White
(74) *Attorney, Agent, or Firm*—Bachman & LaPointe, P.C.

(57) ABSTRACT

A vernier duct blocker comprising a plurality of vanes each having a width and comprising a forward portion and an aft portion defining a plurality of gas paths each of the plurality of vanes being separated by a plurality of widths, and a rotatably movable ring interposed between the forward portion and the aft portion comprising a plurality of openings each having a width, wherein the width of one of the plurality of vanes differs from the width of another one of the plurality of vanes.

10 Claims, 4 Drawing Sheets

VERNIER DUCT BLOCKER

U.S. GOVERNMENT RIGHTS

The invention was made with U.S. Government support under contract N00019-02-C-3003 awarded by the U.S. Navy. The U.S. Government has certain rights in the invention.

BACKGROUND OF THE INVENTION (1) Field of the Invention

The present invention relates to an apparatus, and method for using such an apparatus, for controlling the flowpath area in a gas turbine engine. More specifically, the present invention relates to an apparatus for providing non-linear flowpath area control of a gas turbine engine through the use of vernier duct blocker.

(2) Description of the Related Art

When operating gas turbine engines, it is frequently desirable to control the amount of gas flowing through the secondary flowpath between the outer duct and the inner support structure. One common method of achieving such control is to install an apparatus for adjusting the area through which the gas may flow. Such flow blockers often include a rotatable member with a plurality of openings that can be rotated in order to control the size of an open area through which gas can flow. With reference to FIG. 1, there is illustrated one such apparatus. A number of vanes 21 are circumferentially attached about a ring or rings each vane separated from its neighbor by a uniform distance w. Each vane is formed of a forward portion 15 and an aft portion 13, which, together, form an airfoil shaped vane 21. Between each forward portion 15 and each aft portion 13, there is positioned a rotatably movable ring 11. Rotatably movable ring 11 has a series of openings 17 each of a width w and spaced so as to generally correspond to the widths w between each adjacent pair of vanes 21.

With reference to FIG. 4*a* there is illustrated a view of a portion of a flow blocker 10 looking aft and directly towards the leading edges 23 of the aft portions 13. To assist in visualization, the forward portions 15 of each vane 21 are not shown. When the openings 17 of the rotatably movable ring 11 are aligned with the spaces between adjacent vanes 21, the flow blocker 10 is in a fully open position whereby a maximum opening, consisting of the sum of all unblocked openings 17, is created. With reference to FIG. 4*b*, it is evident that when rotatably movable plate 11 is rotated, the sum of the unblocked portions of all openings 17, is substantially reduced.

It is most desirable for a flow blocker 10 to provide for complete, or nearly complete, blockage of gas flow when necessary while causing little if any blockage when needed. In addition, it is often the case that there are located several flow blockers arranged in series along a central axis 19 of a gas turbine engine. Depending on the flight envelope in which an engine is operating, differing flow blockers will be adjusted to provide for differing opening areas through which gas can flow. Unfortunately, there typically exists a linear relationship between the angular rotation of the rotatably movable ring 11 and the size of the resultant opening through which gas can flow. As a result, in instances wherein one wishes to finely control the area of an opening such that only a small area is provided through which gas can flow, small angular adjustments of the rotatably movable ring 11 result in relatively large differences in the opening area through which gas can flow.

What is therefore needed is a flow blocker 10, and method for so using such a flow blocker, that permits a wide range of adjustable opening sizes through which gas can flow while allowing for fine control of the opening sizes when a small opening size is desired.

SUMMARY OF THE INVENTION

Accordingly, it is an object of the present invention to provide an apparatus, and method for using such an apparatus, for controlling the flowpath area in a gas turbine engine. More specifically, the present invention relates to an apparatus for providing non-linear flowpath area control of a gas turbine engine through the use of vernier duct blocker.

In accordance with the present invention, a vernier duct blocker comprises a plurality of vanes each having a width and comprising a forward portion and an aft portion defining a plurality of gas paths each of the plurality of vanes being separated by a plurality of widths, and a rotatably movable ring interposed between the forward portion and the aft portion comprising a plurality of openings each having a width, wherein the width of one of the plurality of vanes differs from the width of another one of the plurality of vanes.

In further accordance with the present invention, a method of controlling gas flow through a gas flowpath comprises the steps of providing a plurality of vanes each having a width and comprising a forward portion and an aft portion defining a plurality of gas paths each of the plurality of vanes being separated by a plurality of widths, providing a rotatably movable ring interposed between the forward portion and the aft portion comprising a plurality of openings each having a width wherein the width of one of the plurality of vanes differs from the width of another one of the plurality of vanes, and rotating the rotatably movable ring about a central axis to at least partially block a flow of a gas through the plurality of gas paths.

DETAILED DESCRIPTION

It is the teaching of the present invention to provide a vernier duct blocker comprised of varying width vanes and a rotatably movable ring to control the size of the area of duct blockage. A plurality of vanes is circumferentially disposed about a central axis of a gas turbine engine. Each vane is formed of an aft portion and a forward portion.

Between the aft portion and the forward portion there is located a rotatably movable ring which contains openings through which gas can flow. Like the prior art, the openings in the rotatably movable ring can be aligned with the spaces between adjacent vanes so that gas can flow predominantly unimpeded between each of the vanes. However, unlike the prior art, the vernier duct blocker of the present invention is formed from vanes whose widths differ one from the other. As a result, the spaces between the vanes vary as opposed to the constant spacing between the vanes of the prior art. Such differing widths of the vanes and spaces between the vanes allows for a non-linear relationship between the rotation of the rotatably movable ring from a fully open position and the total area formed by the openings in the rotatably movable ring between which gas can flow. The widths of the vanes and the spaces between the vanes are chosen to provide this non-linear relationship in a fashion such that very fine control of the opening area is achieved when the duct blocker is operating in a restrictive mode. By restrictive mode, it is meant that the rotatably movable ring is positioned such that the exposed openings in the rotatably movable ring between the vanes is small relative to the sum total of the openings in the rotatably movable ring when positioned in a fully open position.

Figure 1:
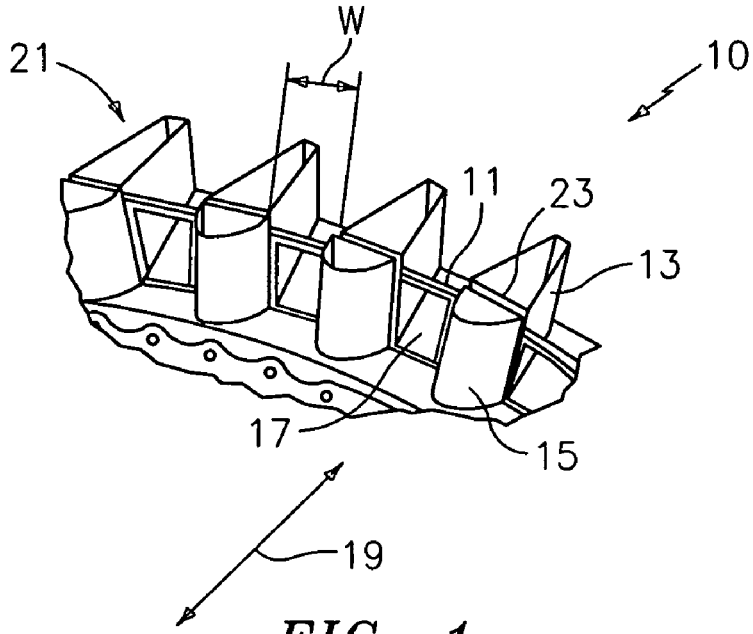
FIG. 1 (PRIOR ART)
FIG. 1 A perspective view of a split vane flow blocker known in the art.
Figure 2:
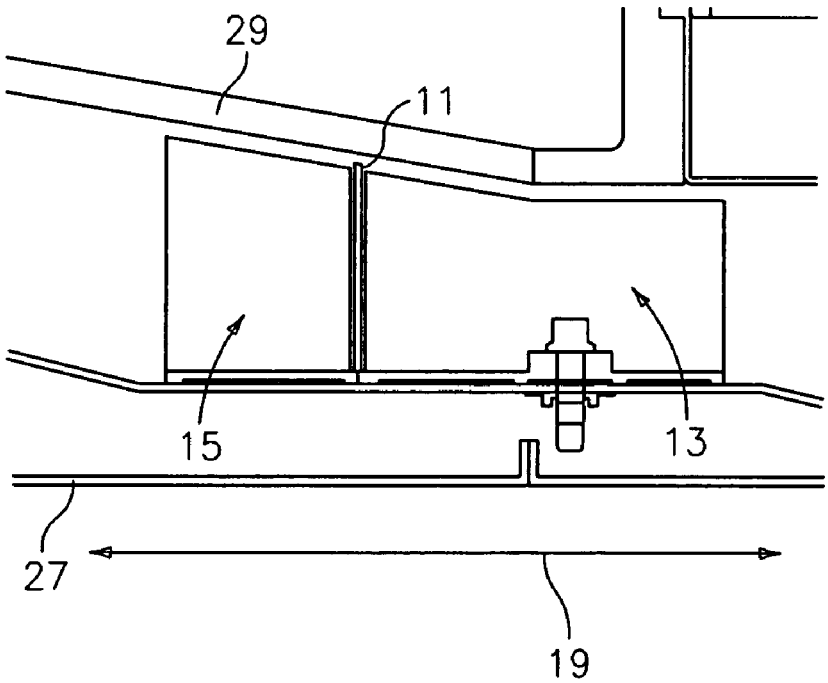
FIG. 2 A side view of the vernier duct blocker of the present intention.
Figure 3:
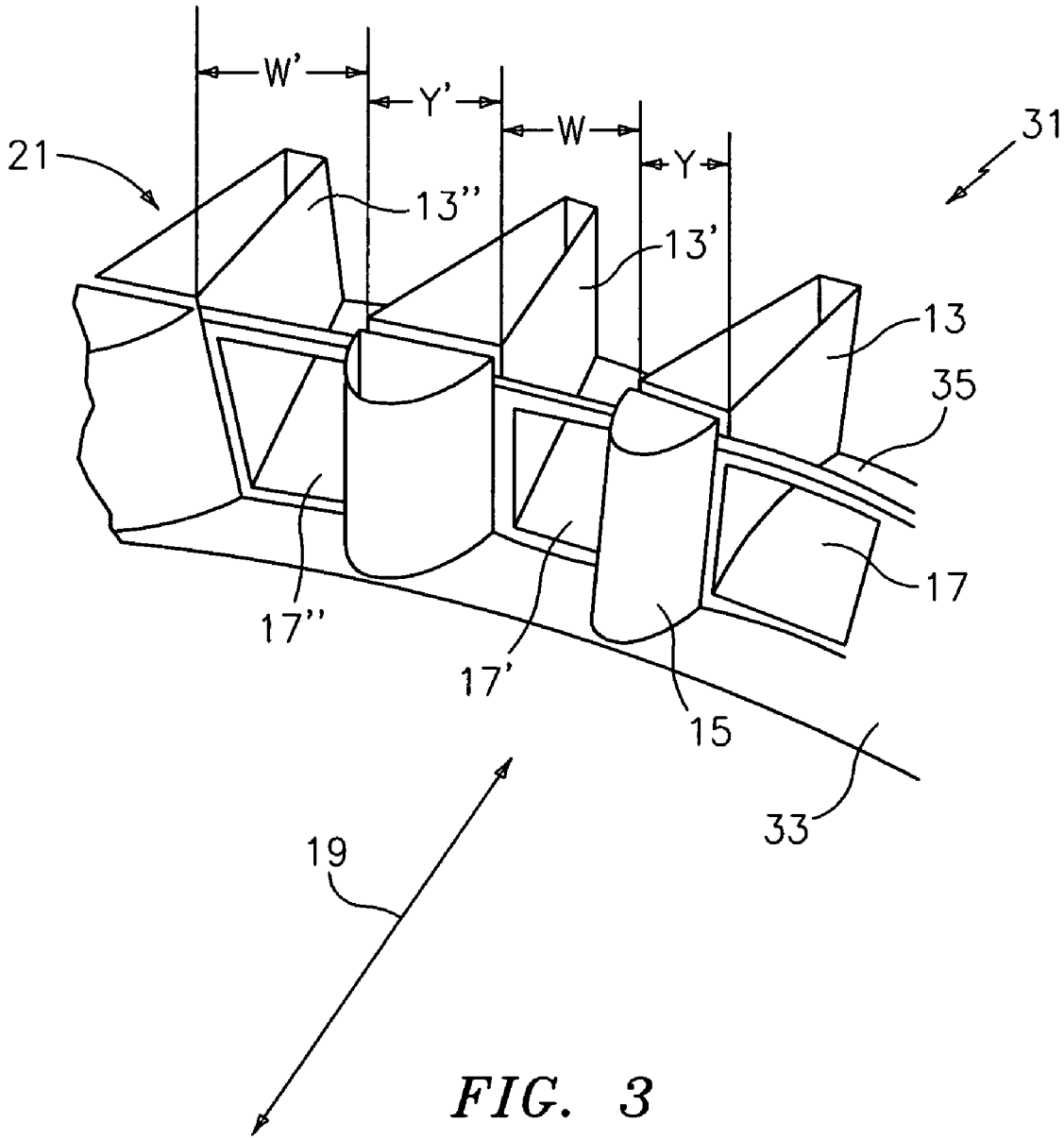
FIG. 3 A perspective view of the vernier duct blocker of the present invention.
Figure 4A:
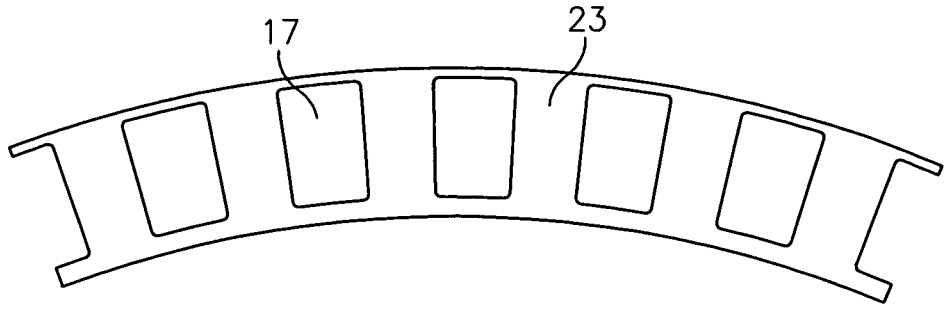
FIG. 4*a* An illustration of a flow blocker known in the art shown in the fully open position.
Figure 4B:
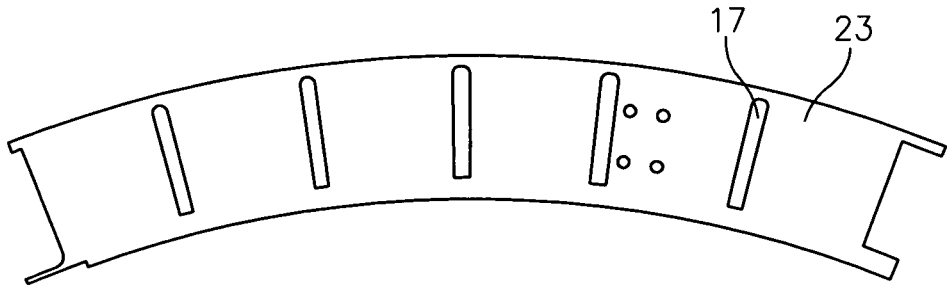
FIG. 4*b* An illustration of a flow blocker known in the art shown in a partially closed position.

With reference to FIG. 3, there is illustrated a vernier duct blocker 31 of the present invention. Vernier duct blocker consists of numerous vanes 21 each formed of a forward portion 15 and an aft portion 13. The forward portions 15 and the aft portions 13 are circumferentially disposed about a forward ring 33 and an aft ring 35, respectively. Both forward ring 33 and aft ring 35 are of essentially identical diameters and are disposed about a central axis 19 of a turbine engine. As such, each vane 21 comprised of a forward portion 15 and an aft portion 13 is located in a secondary flowpath between an outer duct 29 and an inner support structure 27 of a gas turbine engine as shown in FIG. 2. Disposed between forward ring 33 and aft ring 35 is a rotatably movable ring 11. Rotatably movable ring 11 is likewise circumferentially disposed about the central axis 19 of a gas turbine engine. Note that the vanes 21 of the vernier duct blocker 31 are of differing widths. For example, aft portion 13 and aft portion 13' are of widths Y and Y', respectively, Y and Y' not being equal. Similarly, vanes 21 are separated by non-uniform distances. Note specifically that the distance between aft portion 13" and aft portion 13' is equal to a width of W' while the distance between aft portion 13' and aft portion 13 are separated by a distance of W, W not equal to W'.

Disposed between forward ring 33 and aft ring 35 is a rotatably movable ring 11 into which is fabricated a plurality of openings 17. The width of individual openings 17 and the distance between such openings 17 are selected such that in at least one position, rotatably movable ring 11 may be rotated into a fully open position as illustrated in FIG. 3. By "fully open position" it is meant that in such a position the sum total of the area comprising each individual opening 17 not blocked by any forward portion 15 is at a maximum. Preferably, in a fully open position, the expanse formed between any two adjacent vanes 21 is predominantly in correspondence to a single opening 17 such that gas can flow virtually unimpeded between the vanes 21.

Figure 5A:
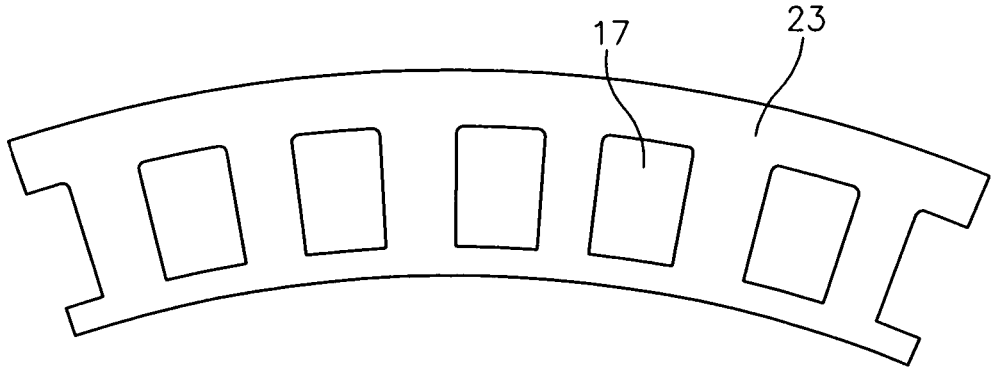
FIG. 5*a* An illustration of the vernier duct blocker of the present invention shown in the fully open position.
Figure 5B:
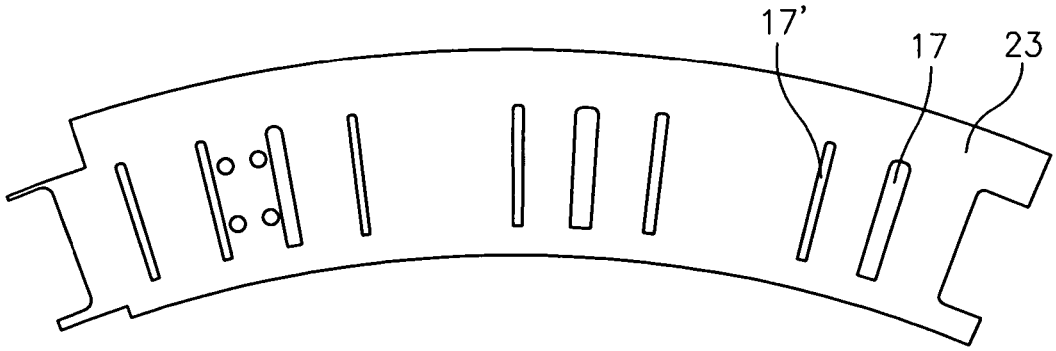
FIG. 5*b* An illustration of the vernier duct blocker of the present invention shown in a partially closed position.

With reference to FIG. 5*a* there is illustrated a view of a portion of a vernier duct blocker 31 looking aft and directly towards the leading edges 23 of the aft portions 13. To assist in visualization, the forward portions 15 of each vane 21 are not shown. When the openings 17 of the rotatably movable ring 11 are aligned with the spaces between adjacent vanes 21, the flow blocker 10 is in a fully open position whereby a maximum opening, consisting of the sum of all unblocked openings 17, is created. With reference to FIG. 5*b*, it is evident that when rotatably movable plate 11 is rotated, the sum of the unblocked portions of all openings 17, is substantially reduced. Furthermore, it is evident that moving the rotatably movable ring 11 out of a fully open position results in a plurality of openings 17, 17' of differing widths. As a result of these differing opening 17 widths, there results a non-linear relationship between the degree of rotation of the rotatably movable ring 11 and the sum total of the open area formed of each individual opening 17 through which gas may flow.

Figure 6:
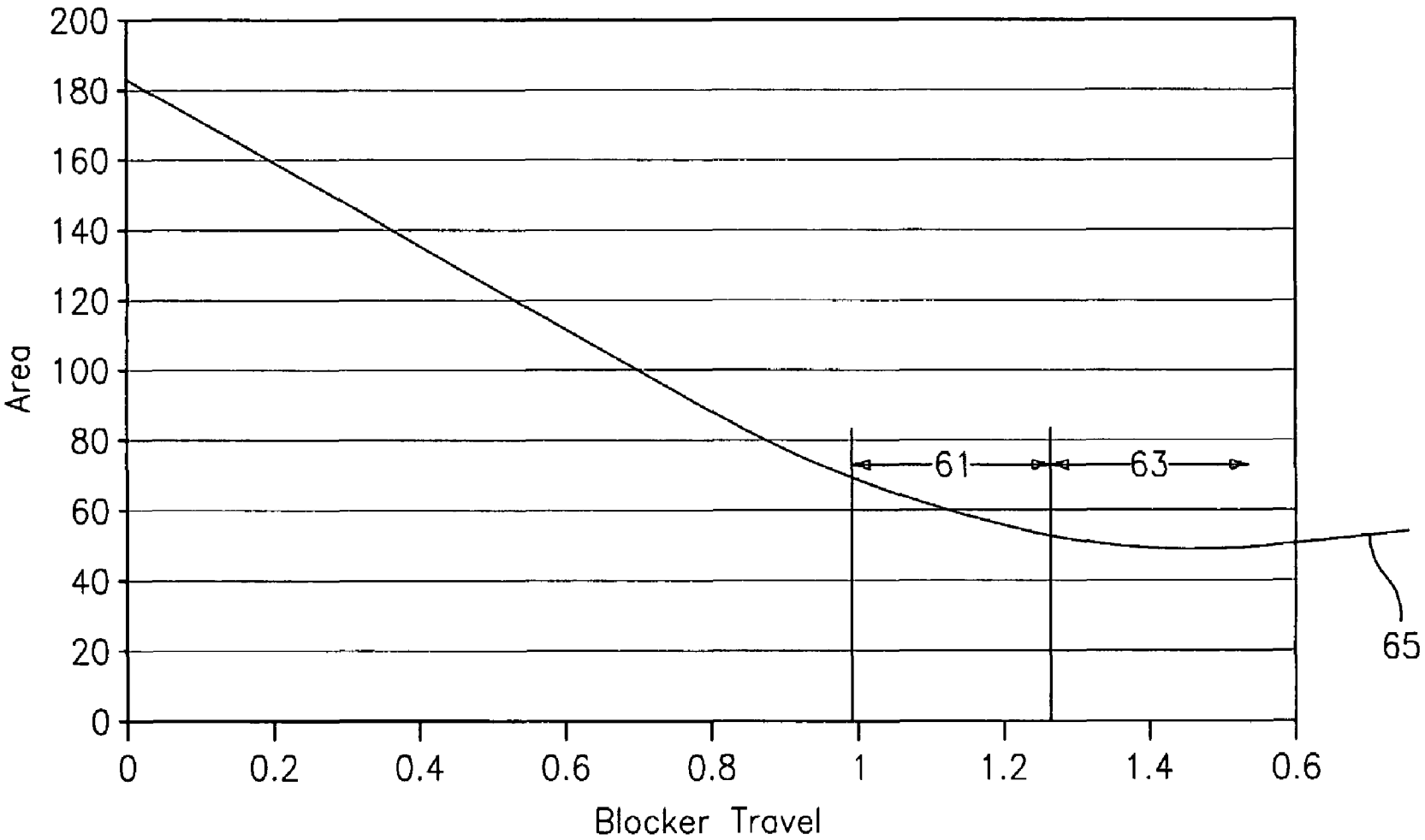
FIG. 6 A graph illustrating the non-linear relationship between the open area of the vernier duct blocker of the present invention through which gas may flow versus radial displacement of the rotatably movable ring.

With reference to FIG. 6, there is illustrated an exemplary graph showing the relationship between the open area created from the openings 17 of the vernier duct blocker of the present invention versus the angular rotation of the rotatably movable ring 11. The x axis represents the linear displacement of the rotatably movable ring 11 from the fully open position. When the rotatably movable ring 11 is in a fully open position, it has no displacement. In the illustrated example, when in the fully open position, the vernier duct blocker provides 180 units$^2$ of opening through which gas can flow. As the displacement of the rotatably movable ring 11 is increased through a rotation distance, the open area created by the openings 17 decreases. Note that this decrease is predominantly linear until a non-linear region 61 is reached. Non-linear region 61 is a region within which further displacement of the rotatably movable ring 11 away from the fully open position results in a slower decrease in the open area created by the openings 17. As a result, as the total open area created by the openings 17 becomes small, relatively large rotational movements of the rotatably movable ring 11 result in small reductions in the open area through which gas can flow. This provides for fine control of the open area. In the embodiment pictured, the spacing between the vanes 21 and the openings 17 of the vernier duct blocker 31 are chosen such that, in its least open position, the open area through which gas can flow formed of the unblocked openings 17 does not approach zero, but rather tends towards a minimum open area value 65 observed during the minimum open area region 61.

It is apparent that there has been provided in accordance with the present invention an apparatus for providing non-linear flowpath area control of a gas turbine engine which fully satisfies the objects, means, and advantages set forth previously herein. While the present invention has been described in the context of specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. A vernier duct blocker comprising:

a plurality of vanes each having a width and comprising a forward portion and an aft portion defining a plurality of gas paths each of said plurality of vanes being separated by a plurality of widths; and a rotatably movable ring interposed between said forward portion and said aft portion comprising a plurality of openings each having a width;

wherein said width of one of said plurality of vanes differs from said width of another one of said plurality of vanes.

2. The blocker of claim 1 wherein said width of one of said plurality of openings differs from said width of another one of said plurality of openings.

3. The blocker of claim 1 wherein said rotatably movable ring can be rotated about a central axis for a rotation distance.

4. The blocker of claim 3 wherein said movable ring can be positioned in a fully open position.

5. The blocker of claim 3 wherein said rotatably movable ring can be rotated about said central axis to provide a generally linear relationship between said plurality of said openings not blocked by one of said plurality of vanes and said rotation distance.

6. The blocker of claim 3 wherein said rotatably movable ring can be rotated about said central axis to provide a generally non-linear relationship between said plurality of said openings not blocked by one of said plurality of vanes and said rotation distance.

7. The blocker of claim 1 wherein each of said plurality of vanes has an airfoil shape.

8. The flow blocker of claim 1 wherein each of said plurality of vanes is located in a flowpath of a gas turbine engine.

9. The flow blocker of claim 8 wherein said flowpath is a secondary flowpath.

10. A method of controlling gas flow through a gas flowpath comprising the steps of:

providing a plurality of vanes each having a width and comprising a forward portion and an aft portion defining a plurality of gas paths each of said plurality of vanes being separated by a plurality of widths;

providing a rotatably movable ring interposed between said forward portion and said aft portion comprising a plurality of openings each having a width wherein said width of one of said plurality of vanes differs from said width of another one of said plurality of vanes; and rotating said rotatably movable ring about a central axis to at least partially block a flow of a gas through said plurality of gas paths.

* * * * *